US009446325B2

(12) United States Patent
Kudo et al.

(10) Patent No.: US 9,446,325 B2
(45) Date of Patent: Sep. 20, 2016

(54) REMOTE CONTROL SYSTEM

(75) Inventors: Gen Kudo, Kanagawa (JP); Toshiyuki Kurosaki, Tokyo (JP); Hideki Tanabe, Tokyo (JP); Kiyoto Shibuya, Saitama (JP)

(73) Assignees: Sony Corporation, Tokyo (JP); Sony Interactive Entertainment Inc., Tokyo (JP)

( * ) Notice: Subject to any disclaimer, the term of this patent is extended or adjusted under 35 U.S.C. 154(b) by 1033 days.

(21) Appl. No.: 13/380,652

(22) PCT Filed: May 11, 2010

(86) PCT No.: PCT/JP2010/057968

§ 371 (c)(1),
(2), (4) Date: Feb. 29, 2012

(87) PCT Pub. No.: WO2011/013428

PCT Pub. Date: Feb. 3, 2011

(65) Prior Publication Data

US 2012/0146775 A1 Jun. 14, 2012

(30) Foreign Application Priority Data

Jul. 31, 2009 (JP) ..... 2009-178641

(51) Int. Cl.
*G08C 19/28* (2006.01)
*A63H 30/04* (2006.01)

(52) U.S. Cl.
CPC ..... *A63H 30/04* (2013.01); *G08C 19/28* (2013.01)

(58) Field of Classification Search
CPC ..... A63H 30/04; A63H 17/00; A63H 30/00; A63H 17/002; A63H 27/06; A63H 27/12
USPC ..... 340/3.1, 3.21, 4.11, 4.3, 4.31, 4.42, 340/4.61, 4.62, 5.1, 12.22–12.3, 12.5; 398/115–126
See application file for complete search history.

(56) References Cited

U.S. PATENT DOCUMENTS 6,773,322 B2 8/2004 Gabai et al.
8,216,036 B2 * 7/2012 Eyzaguirre et al. ..... 463/2

(Continued)

FOREIGN PATENT DOCUMENTS

DE 19902852 C1 7/2008
DE 19923105 C1 7/2008

(Continued)

OTHER PUBLICATIONS

Supplementary European Search Report for corresponding European Patent Application No. 10804176, dated Aug. 29, 2013.

(Continued)

*Primary Examiner* — Steven Lim
*Assistant Examiner* — Mancil Littlejohn, Jr.
(74) *Attorney, Agent, or Firm* — Matthew B. Dernier, Esq.

(57) ABSTRACT

Provided is a communication processing module, which is compatible with various kinds of devices to be operated by an operation input device. The communication processing module for the device to be operated receives any one of a standard operation signal specifying a standard action and a specific operation signal specifying an action unique to the device to be operated, which are transmitted by the operation input device. When the received operation signal is the standard operation signal, the communication processing module causes the device to be operated to execute an action corresponding to a content of the operation signal, and when the received operation signal is the specific operation signal, transfers data contained in the signal to a unique processing module. The unique processing module causes the device to be operated to execute an action corresponding to a content of the data transferred from the communication processing module.

24 Claims, 5 Drawing Sheets

(56) References Cited

U.S. PATENT DOCUMENTS

| | | | | |
|---|---|---|---|---|
| 2001/0031603 | A1 | 10/2001 | Gabai et al. | |
| 2002/0199081 | A1* | 12/2002 | Satou | 712/34 |
| 2003/0130770 | A1* | 7/2003 | Matos | G05D 1/0022 701/3 |
| 2005/0255831 | A1* | 11/2005 | Kato | H04W 12/08 455/411 |
| 2006/0271251 | A1* | 11/2006 | Hopkins | A63H 30/04 701/23 |
| 2008/0046818 | A1* | 2/2008 | Orgill | G06F 15/16 715/700 |
| 2010/0203933 | A1 | 8/2010 | Eyzaguirre et al. | |

FOREIGN PATENT DOCUMENTS

| | | | | |
|---|---|---|---|---|
| EP | 1961473 | A1 | 8/2008 | |
| JP | 2002341937 | * | 5/2001 | B25J 19/00 |
| JP | 2001525716 | A | 12/2001 | |
| JP | 2002341937 | A * | 11/2002 | G05D 1/00 |
| JP | 2004064418 | A | 2/2004 | |
| JP | 2005328295 | A | 11/2005 | |
| JP | 2008-011050 | A | 1/2008 | |
| WO | 2008145980 | A1 | 12/2008 | |

OTHER PUBLICATIONS

International Search Report for corresponding application PCT/JP2010/057968, Aug. 17, 2010.

International Preliminary Report on Patentability for corresponding application PCT/JP2010/057968, dated Feb. 23, 2012.

Office Action for Japanese Patent Application No. 2009-178641, dated on May 14, 2013.

* cited by examiner

REMOTE CONTROL SYSTEM

TECHNICAL FIELD

The present invention relates to a device to be operated, such as a moving object, which performs an action in accordance with an operation signal transmitted from an operation input device. The present invention also relates to a communication processing module installed in the device to be operated, a remote control system including a device to be operated and an operation input device, and a method of controlling a device to be operated.

BACKGROUND ART

There is known a remote control system configured such that a user performs an operation input with respect to an operation input device, to thereby operate a device to be operated which is communicably connected to the operation input device by wireless. Specific examples of the device to be operated include such a moving object as a radio-controlled car, which moves in accordance with an operation signal from the operation input device. With the remote control system described above, the device to be operated is installed with a communication processing module so as to receive and process the operation signal transmitted from the operation input device (for example, see Patent Document 1).

PRIOR ART DOCUMENT

Patent Document

[Patent Document 1]: WO 2008/145980 A1

The above-mentioned communication processing module is expected to be installed in various kinds of devices to be operated, such as a vehicle-type toy and a plane-type toy. However, the devices to be operated are capable of various actions depending on the kind thereof, and, in some cases, include various kinds of sensors or the like. For this reason, when the communication processing module can handle only a limited number of control commands, it is difficult to realize such various kinds of control for the device to be operated. On the other hand, it is uneconomical to prepare, for each kind of the device to be operated, a communication processing module which can handle control commands unique to the device to be operated in question.

SUMMARY OF THE INVENTION

The present invention has been made in view of the above-mentioned circumstances, and an object thereof is to provide a communication processing module compatible with various kinds of devices to be operated, a device to be operated, such as a moving object, which includes the communication processing module, a remote control system including such a device to be operated, and a method of controlling a device to be operated.

According to the present invention, there is provided a remote control system, including: an operation input device; and a device to be operated, which performs an action in accordance with an operation signal transmitted from the operation input device by wireless, in which the operation input device transmits, as the operation signal, anyone of a standard operation signal specifying a standard action and a specific operation signal specifying an action unique to the device to be operated, to the device to be operated, in which the device to be operated includes: a communication processing module for receiving the operation signal transmitted from the operation input device; and a unique processing module for controlling the device to be operated to execute the action unique to the device to be operated, in which the communication processing module causes the device to be operated to execute an action corresponding to a content of the operation signal when the received operation signal is the standard operation signal, and transfers data contained in the operation signal to the unique processing module when the received operation signal is the specific operation signal, and in which the unique processing module causes the device to be operated to execute an action corresponding to a content of the data transferred from the communication processing module.

In the above-mentioned remote control system, the device to be operated may be a moving object which moves in accordance with the operation signal, the device to be operated may further include a drive portion which is driven in accordance with a drive signal output from the communication processing module or the unique processing module, the communication processing module may output, to the drive portion, a drive signal corresponding to the content of the operation signal when the received operation signal is the standard operation signal, and the unique processing module may output, to the drive portion, a drive signal corresponding to the content of the data transferred from the communication processing module.

Further, in the above-mentioned remote control system, the communication processing module may refer to a predetermined portion contained in the operation signal, to thereby determine whether the operation signal is the standard operation signal or the specific operation signal.

Further, according to the present invention, there is provided a device to be operated, which performs an action in accordance with an operation signal transmitted from an operation input device by wireless, the device to be operated including: a communication processing module for receiving, as the operation signal, any one of a standard operation signal specifying a standard action and a specific operation signal specifying an action unique to the device to be operated, from the operation input device; and a unique processing module for controlling the device to be operated to execute the action unique to the device to be operated, in which the communication processing module causes the device to be operated to execute an action corresponding to a content of the operation signal when the received operation signal is the standard operation signal, and transfers data contained in the operation signal to the unique processing module when the received operation signal is the specific operation signal, and in which the unique processing module causes the device to be operated to execute an action corresponding to a content of the data transferred from the communication processing module.

Further, according to the present invention, there is provided a communication processing module to be installed in a device to be operated which performs an action in accordance with an operation signal transmitted from an operation input device by wireless, the communication processing module including: means for receiving, as the operation signal, any one of a standard operation signal specifying a standard action and a specific operation signal specifying an action unique to the device to be operated, from the operation input device; means for generating, when the received operation signal is the standard operation signal, an action signal for causing the device to be operated to execute an action corresponding to a content of the operation signal, and outputting the action signal; and means for transferring, when the received operation signal is the specific operation signal, data contained in the operation signal to a unique processing module which is included in the device to be operated and performs action control unique to the device to be operated.

Further, according to the present invention, there is provided a method of controlling a device to be operated which includes a communication processing module and a unique processing module, and performs an action in accordance with an operation signal transmitted from an operation input device by wireless, the method of controlling a device to be operated including: receiving, as the operation signal, any one of a standard operation signal specifying a standard action and a specific operation signal specifying an action unique to the device to be operated, from the operation input device; causing, by the communication processing module, the device to be operated to execute an action corresponding to a content of the operation signal when the received operation signal is the standard operation signal; transferring, by the communication processing module, data contained in the operation signal to the unique processing module when the received operation signal is the specific operation signal; and causing, by the unique processing module, the device to be operated to execute an action corresponding to a content of the transferred data.

Further, according to the present invention, there is provided another remote control system, including: an operation input device; and a device to be operated, which performs an action in accordance with an operation signal transmitted from the operation input device through wireless communication, in which the operation input device includes: means for establishing a wireless communication connection to the device to be operated, by using communication setting information held in advance in the device to be operated; means for transmitting, to the device to be operated, an instruction to rewrite the held communication setting information into other communication setting information by using the established wireless communication connection; and means for reestablishing the wireless communication connection to the device to be operated, by using the other communication setting information obtained through the rewrite, and in which the device to be operated includes: means for holding the communication setting information; means for rewriting the held communication setting information in accordance with the instruction from the operation input device; and means for performing communication to the operation input device by using the held communication setting information.

In the above-mentioned remote control system, the device to be operated may further include a reset switch, and, when the reset switch is depressed, return the held communication setting information to initial information.

Further, in the above-mentioned remote control system, the device to be operated may be a moving object which moves in accordance with the operation signal.

Further, according to the present invention, there is provided still another remote control system, including: an operation input device; and a moving object which moves in accordance with an operation signal transmitted from the operation input device through wireless communication, in which the moving object includes: a communication processing module for receiving the operation signal transmitted from the operation input device, and outputting a drive signal corresponding to the received operation signal; and a drive portion which is driven in accordance with the drive signal output from the communication processing module, and in which the communication processing module outputs, when the wireless communication is disconnected, a drive signal for causing the drive portion to execute a predetermined action so as to shift the moving object to a predetermined state.

In the above-mentioned remote control system, the operation input device may generate control information for disconnection which defines a content of the drive signal for causing the drive portion to execute the predetermined action, and transmit the control information for disconnection to the moving object, and in which the communication processing module may hold a content of the transmitted control information for disconnection, and, when the wireless communication is disconnected, output the drive signal defined by the held control information for disconnection.

DETAILED DESCRIPTION OF THE PREFERRED EMBODIMENTS

Hereinbelow, an embodiment of the present invention is described in detail with reference to the drawings.

[Hardware Configuration]

Figure 1:
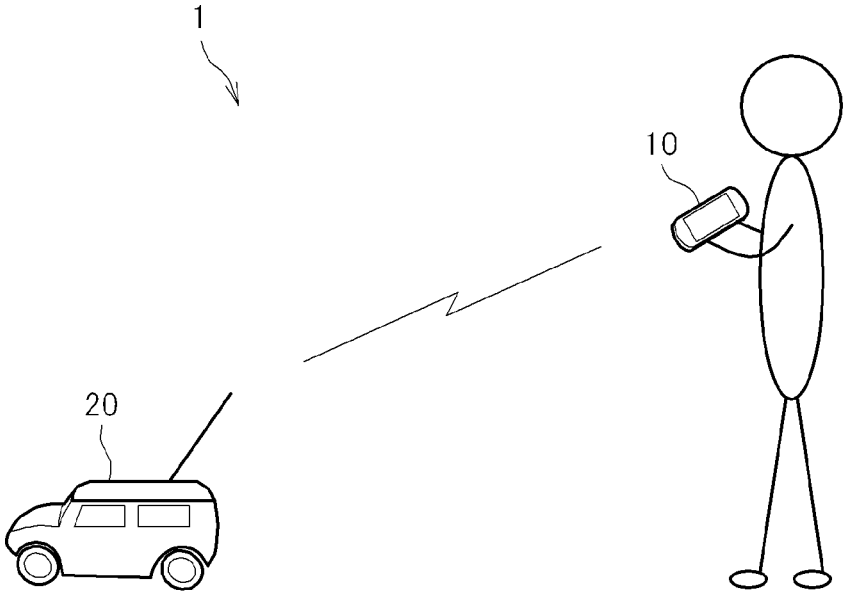
FIG. 1 A schematic diagram of a remote control system according to an embodiment of the present invention.

FIG. 1 is a schematic diagram illustrating an overview of a remote control system 1 according to the embodiment of the present invention. As illustrated in the figure, the remote control system 1 includes an operation input device 10 which is held by a user when used and a moving object 20 which is communicably connected to the operation input device 10 by wireless and moves in accordance with an operation signal transmitted from the operation input device 10. In this embodiment, description is given by taking as an example a case where the moving object 20 is a toy modeling a car (radio-controlled car). However, the moving object 20 is not limited thereto, and may be various kinds of devices movable in accordance with the operation signal from the operation input device 10. For example, the moving object 20 may be any toy modeling various kinds of vehicles, such as a plane, a helicopter, a ship, and a submarine, or may be a robot.

Figure 2:
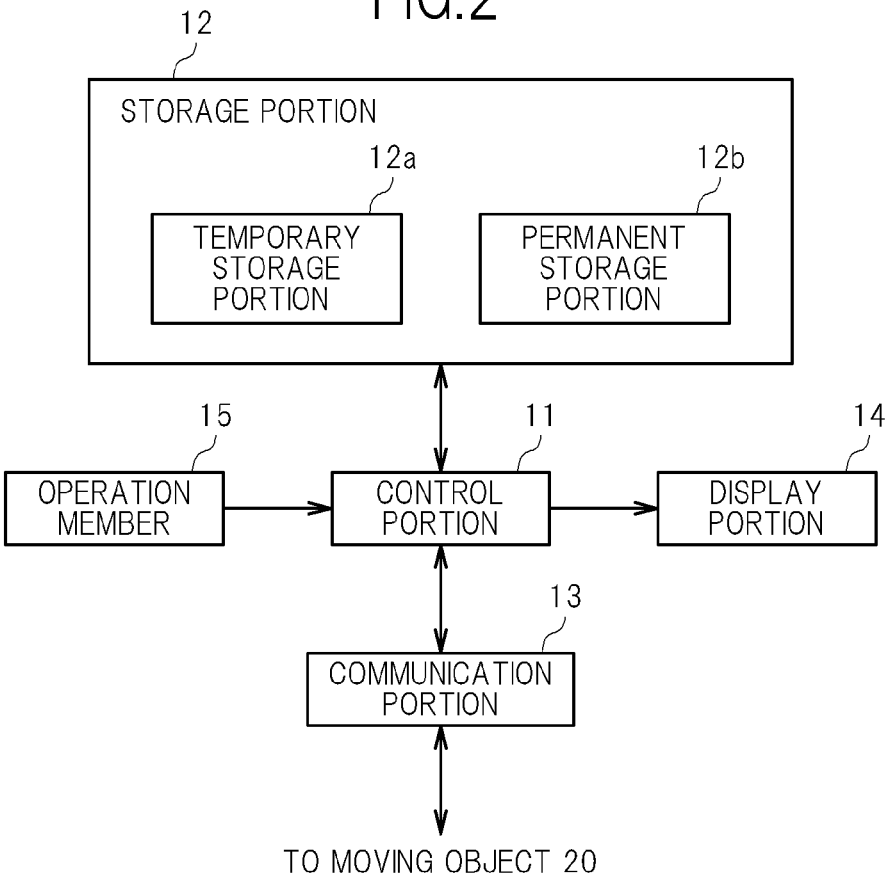
FIG. 2 A block diagram illustrating a configuration of an operation input device.
Figure 3:
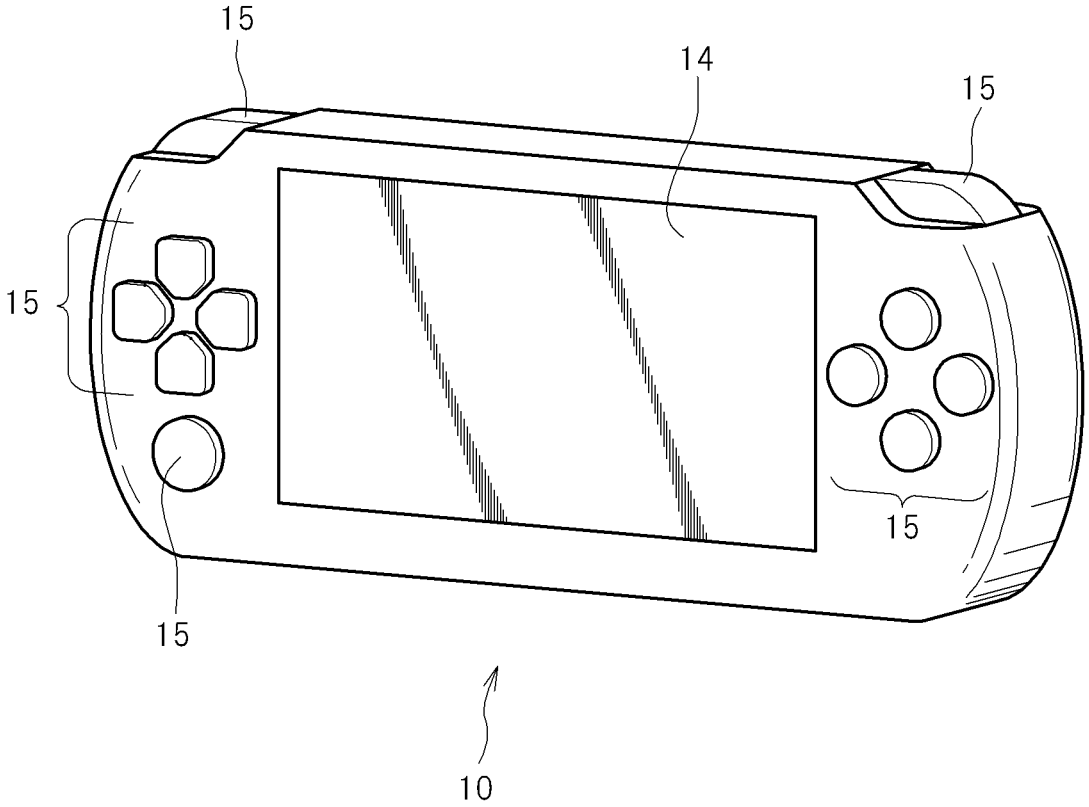
FIG. 3 A perspective view illustrating an example of an outer appearance of the operation input device.

The operation input device 10 is a communication device such as a portable game machine, and as illustrated in FIG. 2, includes a control portion 11, a storage portion 12, and a communication portion 13. Further, FIG. 3 is a perspective view illustrating an example of an outer appearance of the operation input device 10. As illustrated in the figure, on a surface of a casing of the operation input device 10, there are disposed a display portion 14 and various kinds of operation members 15.

The control portion 11 includes a CPU and the like, and executes various kinds of information processing in accordance with a program stored in the storage portion 12. Specifically, the control portion 11 executes an application program for controlling the moving object 20, to thereby perform processing of generating data in accordance with the user's operation input made with respect to the operation member 15 to be described later and transmitting the data to the moving object 20 via the communication portion 13 as the operation signal.

The storage portion 12 includes a temporary storage portion 12*a* and a permanent storage portion 12*b*, and stores the program to be executed by the control portion 11 and various kinds of data. Specifically, the temporary storage portion 12*a*, which includes a memory device such as a RAM, temporarily stores a program or the like which is being executed, and also functions as a work memory of the control portion 11. The permanent storage portion 12*b*, which includes a memory device such as a ROM or a nonvolatile memory and/or a hard disk drive or the like, stores a program and various kinds of data which are to be read to the temporary storage portion 12*a*. Note that, data stored in the temporary storage portion 12*a* is deleted when power supply to the operation input device 10 is turned off, and data stored in the permanent storage portion 12*b* is reusable because the data is retained even after the power supply to the operation input device 10 is turned off.

The communication portion 13 is a communication interface for implementing data transmission/reception to/from the moving object 20 by wireless, and performs wireless LAN communication in accordance with the IEEE 802.11 standard in this embodiment.

The display portion 14 is a liquid crystal display or the like, and displays various kinds of images in accordance with an instruction from the control portion 11. Particularly, in this embodiment, the display portion 14 displays an image which is taken by a camera 25 and transmitted through wireless communication. The camera 25, which is to be described later, is installed in the moving object 20.

The operation member 15 is a button, an analog pad, or the like, and is used by the user to input an operation instruction to the moving object 20. For example, the user gives an action instruction to the moving object 20 by depressing buttons associated with various kinds of actions, such as acceleration, deceleration, start, stop, right turn, left turn, ascending, and descending, of the moving object 20. Further, by sliding an analog pad slidable in any direction of 360 degrees, a moving instruction can be given in any direction. Unlike in the case of giving an instruction by simply turning on/off a button, with the use of the analog pad, the user can give an action instruction whose content corresponds to the amount of an operation made thereto.

Figure 4:
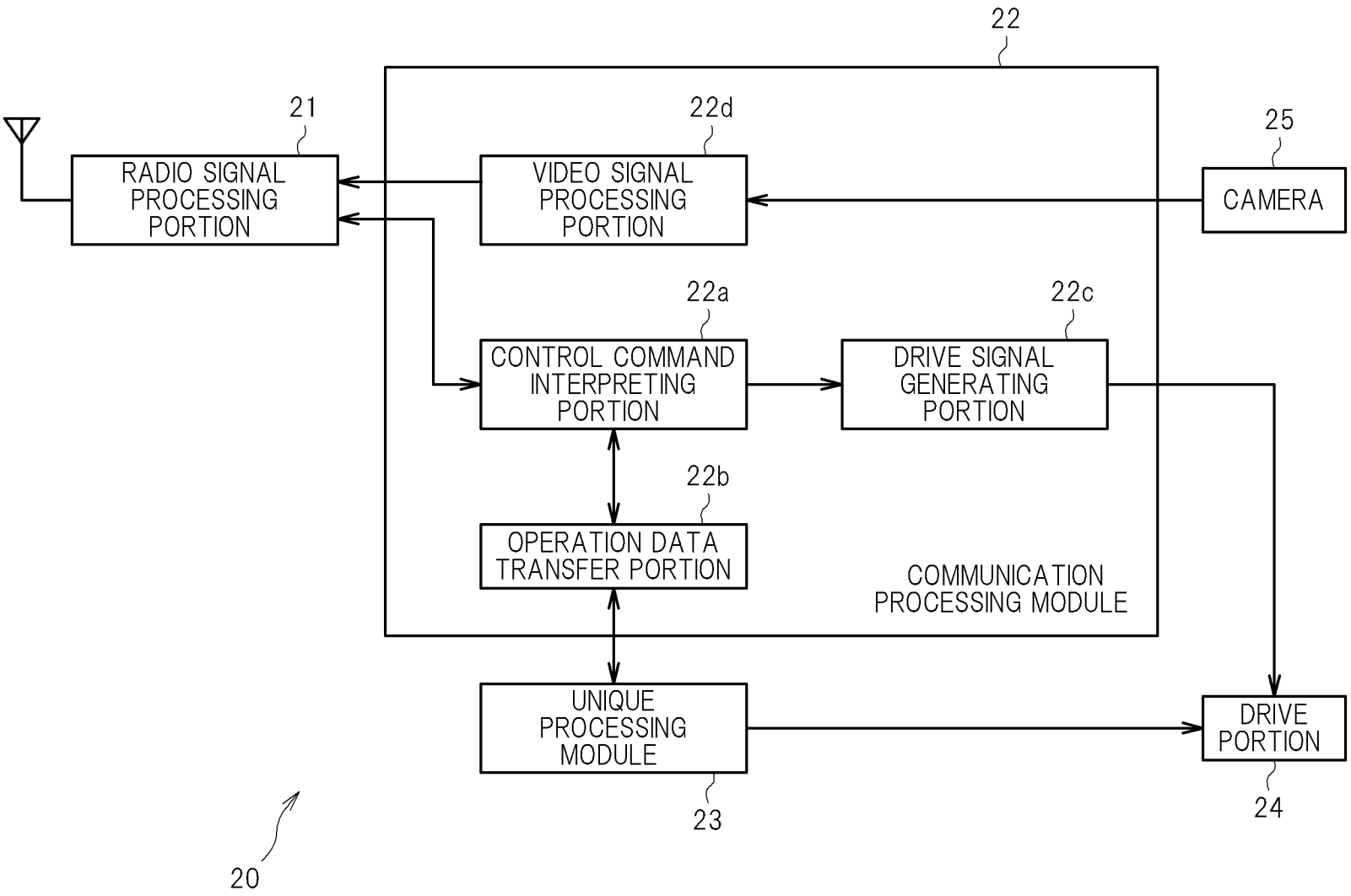
FIG. 4 A block diagram illustrating a configuration of a moving object.

As illustrated in FIG. 4, the moving object 20 includes a radio signal processing portion 21, a communication processing module 22, a unique processing module 23, a drive portion 24, and the camera 25.

The radio signal processing portion 21 is a communication interface for performing transmission/reception of a radio signal to/from the operation input device 10 in conformity with the same communication standard (in this case, the IEEE 802.11 standard) as the communication portion 13 uses.

The communication processing module 22, which is a microcomputer or the like, receives an operation signal from the operation input device 10 via the radio signal processing portion 21, and executes processing which corresponds to the received operation signal. Further, the communication processing module 22 transmits data to the operation input device 10 via the radio signal processing portion 21. Specifically, in response to the operation signal received from the operation input device 10, the communication processing module 22 outputs an action signal for causing the moving object 20 to perform an action to any one of the unique processing module 23 and the drive portion 24, which are to be described later. A specific example of processing executed by the communication processing module 22 in this embodiment is described later.

The unique processing module 23, which is a microcomputer or the like, performs control of causing the moving object 20 to execute an action unique to the moving object 20 in accordance with the content of operation data output from the communication processing module 22. Specifically, the unique processing module 23 generates a drive signal for causing the moving object 20 to execute the action unique to the moving object 20, and then outputs the drive signal to the drive portion 24. Further, in a case where the moving object 20 is equipped with, for example, means for detecting the position of the moving object 20 itself, such as a GPS, sensors for detecting various kinds of states of the moving object 20, or a microphone for collecting sound around the moving object 20, the unique processing module 23 may perform processing of outputting data acquired by those devices to the communication processing module 22.

The drive portion 24 includes a drive mechanism such as a motor or an actuator, and performs an action in accordance with a drive signal output by the communication processing module 22 or the unique processing module 23. The driving of the drive portion 24 causes the moving object 20 to move or change its state. In this embodiment, the moving object 20 is a vehicle-type toy, and hence the drive portion 24 includes a motor for rotating driving wheels, a steering mechanism for changing the direction of the wheels, and the like. The driving of the drive portion 24 causes the vehicle to travel forward/backward or change the direction of travel to the left/right.

The camera 25, which is a CCD camera or the like, takes an image around the moving object 20 (for example, image in front of the moving object 20) as a moving image, and then outputs a video signal representing the taken image to the communication processing module 22. In the communication processing module 22, the moving image is encoded into image data compliant with such standards as Motion JPEG and MPEG-4, and the encoded image data is transmitted to the operation input device 10.

The moving image transmitted from the moving object 20 is decoded by the control portion 11 of the operation input device 10, and is then displayed on the display portion 14. The user performs the operation input while viewing the image displayed on the display portion 14. Thus, even when the moving object 20 does not directly exist in his/her view, the user can remote-control the moving object 20. Note that, in addition to simply decoding the moving image transmitted from the moving object 20, the control portion 11 may execute processing of recognizing the position or the shape of an object included within the moving image by using, for example, a publicly-known object-recognition technology, and use the result of the processing so as to process the moving image before displaying the image on the display portion 14. Further, the image may be displayed on the display portion 14 by overlaying various kinds of image elements, such as image elements indicating information regarding the game, onto the received moving image.

Further, in accordance with an instruction given from the user or a processing content of the application program, the operation input device 10 may record the moving image received from the moving object 20 or may capture, as a still image, an image displayed at a timing specified by the user.

Note that, when the operation signal has not been transmitted from the operation input device 10 for a given period of time, the communication processing module 22 may execute such control that stops the operation of the camera 25 or that stops the transmission of the video signal which has been output by the camera 25.

Hereinbelow, description is given of some features of control performed in the remote control system 1 according to this embodiment.

[Processing in Accordance with the Kind of the Operation Signal]

First, description is given of a specific example of processing executed by the communication processing module 22 of the moving object 20 so as to drive the drive portion 24 in accordance with the operation signal transmitted from the operation input device 10.

In this embodiment, in some cases, the operation input device 10 selectively transmits, as the operation signal for moving the moving object 20, any one of two kinds of signals in accordance with an instruction given from the user or the processing content of the application program. Then, the moving object 20 determines which kind the received operation signal belongs to, and, depending on the result of the determination, processing performed in response to the received operation signal has a different content.

Figure 5:
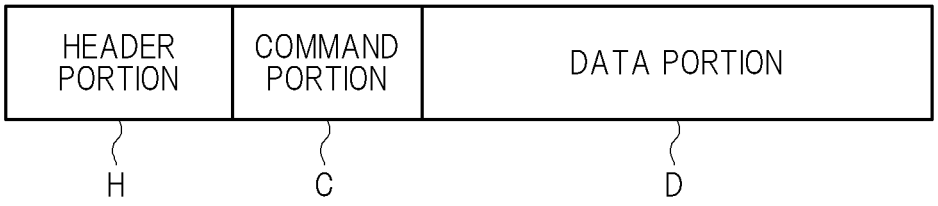
FIG. 5 A diagram schematically illustrating data structure of an operation signal which the operation input device transmits to the moving object.

Specifically, the operation signal transmitted from the operation input device 10 to the moving object 20 is classified into a standard operation signal for specifying a standard action common to various kinds of the moving objects 20, and a specific operation signal for, depending on the kind of the moving object 20, causing the moving object 20 to perform an action unique to that kind of the moving object 20. In this embodiment, as illustrated in FIG. 5, a communication packet transmitted as the operation signal from the operation input device 10 to the moving object 20 contains a header portion H, a predetermined portion storing information indicating the kind of a control command (hereinbelow, referred to as command portion C), and a portion storing a data content to be transmitted subsequently thereto (hereinbelow, referred to as data portion D).

In the case of the standard operation signal, the command portion C contains information indicating any one of standard commands which are prepared in advance, and the data portion D contains parameter information and the like which define details to be executed with the standard command. The standard command is a control command used in common to operate various kinds of the moving objects 20. For example, in the case of such a standard command that specifies an action for a vehicle, the data portion D contains information for specifying a specific action of the moving object 20, such as forward movement, backward movement, left turn, and right turn. The application program executed by the operation input device 10 processes the content of the operation input made by the user with respect to the operation member 15, thereby generating those pieces of information.

On the other hand, in the case of the specific operation signal, the command portion C contains a predetermined control command (hereinbelow, referred to as transfer command) giving an instruction to transfer data within the data portion D to the unique processing module 23 without any change. Further, the data portion D stores the operation data indicating the content of an operation made by the user. Here, the operation data is information indicating the content of an operation made by the user with respect to the operation member 15 of the operation input device 10. Note that, the data stored in the data portion D of the specific operation signal is not limited to the operation data, and may be various kinds of data generated by the application program on the operation input device 10 side.

Hereinbelow, description is given of a function of the communication processing module 22 for implementing such processing with respect to the two kinds of operation signals.

In this embodiment, as illustrated in FIG. 4, the communication processing module 22 functionally includes a control command interpreting portion 22*a*, an operation data transfer portion 22*b*, a drive signal generating portion 22*c*, and a video signal processing portion 22*d*.

The control command interpreting portion 22*a* refers to information stored in the command portion C of the communication packet received by the radio signal processing portion 21 from the operation input device 10, to thereby identify the kind of the control command. Then, the control command interpreting portion 22*a* executes processing in accordance with the identified kind of the control command. Specifically, when the information stored in the command portion C indicates the transfer command (that is, when the received operation signal is the specific operation signal), the control command interpreting portion 22*a* instructs the operation data transfer portion 22*b* to transfer the operation data stored in the data portion D. In accordance with the instruction from the control command interpreting portion 22*a*, the operation data transfer portion 22*b* transfers the operation data stored in the data portion D to the unique processing module 23.

On the other hand, when the control command interpreting portion 22*a* determines that the operation signal contains the standard command (that is, when the received operation signal is the standard operation signal), the communication processing module 22 performs control of causing the moving object 20 to execute a standard action in accordance with the standard command. Specifically, in accordance with the instruction from the control command interpreting portion 22*a*, the drive signal generating portion 22*c* generates a drive signal. That is, the drive signal generating portion 22*c* refers to the parameter information and the like stored in the data portion D, generates digital data for operating the drive portion 24, and modulates the digital data to the drive signal (analog signal) by using, for example, pulse width modulation (PWM). Then, the thus acquired drive signal is input to the drive portion 24, to thereby move the moving object 20. Note that, the drive signal generated based on the standard operation signal may be similar to a signal which is to be input to a drive system when a radio-controlled car is operated by using, for example, a general proportional system. With this configuration, the drive system provided to a moving object operable by using the conventional proportional system can be used without any change as the drive portion 24 of the moving object 20 of this embodiment.

The video signal processing portion 22*d* encodes the video signal output from the camera 25, generates video data, and outputs the video data to the radio signal processing portion 21. With this configuration, video taken by the camera 25 is transmitted to the operation input device 10. Here, as illustrated in FIG. 4, the operation signal to be transmitted to the moving object 20 from the operation input device 10 side and the video signal to be transmitted to the operation input device 10 from the moving object 20 side are processed separately in the communication processing module 22. Further, in regard to communication connection between the operation input device 10 and the moving object 20, the operation signal and the video signal are transmitted/received via different communication sockets (that is, via logically separated communication paths) as well. Hence, for example, even when the processing load of the video signal has increased, the communication processing module 22 can continue the processing of receiving the operation signal without suffering interruption in midstream.

The unique processing module 23 uses the operation data output from the operation data transfer portion 22*b* to generate a drive signal for causing the moving object 20 to execute an action unique to the moving object 20, and then outputs the drive signal to the drive portion 24. That is, the unique processing module 23 generates and outputs a drive signal for causing the moving object 20 to execute such a special action that cannot be handled with the standard command. Note that, in a case where the drive portion 24 of the moving object 20 performs only an action controllable with the standard command, there is no need for the unique processing module 23 to execute the control of the drive portion 24.

Further, the unique processing module 23 may output information acquired by various kinds of sensors and the like, which are provided to the moving object 20, to the communication processing module 22 as a response to the operation signal transmitted from the operation input device 10. In this case, the communication processing module 22 transmits, to the operation input device 10, a communication packet containing data output from the unique processing module 23 without any change as a response to the operation signal.

With this configuration, the operation input device 10 and the unique processing module 23 can transmit/receive arbitrary data via the communication processing module 22, with the result that the operation input device 10 can give an action instruction to the moving object 20 while collecting various kinds of information regarding the state of the moving object 20. Further, the operation input device 10 gives an action instruction while using the standard operation signal and the unique operation signal selectively. Therefore, in the case of such an action that is common to a plurality of kinds of the moving objects 20, the moving object 20 can process the action within the communication processing module 22, and in the case of such processing that is unique to a specific kind of the moving object 20 and cannot be handled with the communication processing module 22, the processing can be executed by the unique processing module 23.

[Control at the Time of Establishment of Communication Connection]

Next, description is given of processing executed at the time of establishing a communication connection between the operation input device 10 and the moving object 20 for the first time by wireless.

In this embodiment, the operation input device 10 uses communication setting information of the moving object 20 to identify the moving object 20 which is to serve as a communication partner, and performs communication with that moving object 20. Here, the communication setting information is used for identifying the communication partner and establishing a session when a communication connection is achieved, and is, for example, channel information, a service set identifier (SSID), or an IP address. The communication setting information is used for identifying the communication partner, and hence it is preferred that different devices have different values. However, for example, in a case where the moving objects 20 are mass-produced, it may be difficult to set different pieces of communication setting information to all the devices before shipment. Accordingly, for example, regarding the SSID, one possible solution is to set in advance a common value for each model which is determined in accordance with the manufacturer, the type of the moving object 20 (for example, whether the moving object 20 is a vehicle or a plane), or the model number. However, if common values are set in this manner, when a plurality of moving objects 20 exist within a communicable range of one operation input device 10, the operation input device 10 cannot identify the moving object 20 which should be its own operation target from among the plurality of moving objects 20 by using the communication setting information, which may result in crosstalk or the like.

To address this, in this embodiment, the operation input device 10 uses the communication setting information which is set to the moving object 20 in advance and is common to the model (hereinbelow, referred to as common setting information) so as to establish a communication connection, and thereafter gives an instruction to rewrite the common setting information into a different value as necessary, thereby performing reconnection by using the rewritten communication setting information.

Figure 6:
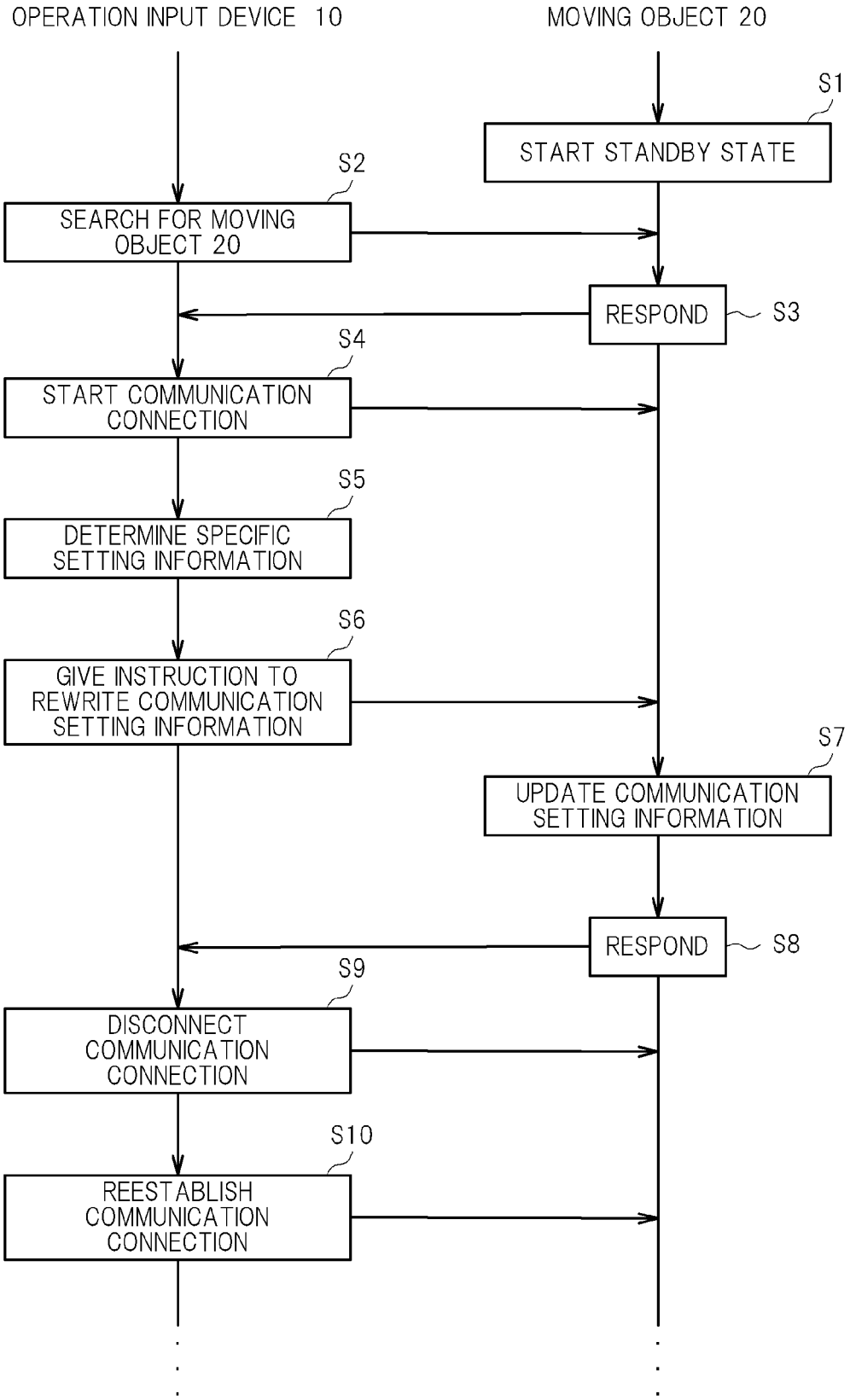
FIG. 6 A flow chart illustrating an example of a flow of processing executed when a communication connection is established between the operation input device and the moving object.

Hereinbelow, referring to a flowchart of FIG. 6, description is given of a specific example of such reconnection processing.

First, for example, when the user turns on the power supply of the moving object 20, the communication processing module 22 of the moving object 20 starts a standby state of waiting for a communication connection from the operation input device 10 (S1). Here, it is assumed that the common setting information common to the model of the moving object 20 is already written before the shipment in the ROM built in the communication processing module 22, and that the content thereof is copied in advance to a predetermined register (hereinbelow, referred to as setting information register). The communication processing module 22 reads the common setting information from the setting information register, and then starts the standby state of waiting for a communication connection from the operation input device 10 with the use of the information thus read.

Next, the operation input device 10 searches for a moving object 20 existing in a communicable range in accordance with an instruction from the user (S2). On this occasion, the operation input device 10 attempts to establish a connection by using the common setting information of the moving object 20, which corresponds to the application program under execution. The common setting information is assumed to be stored in the application program in advance. Note that, when the processing of S2 is executed, a plurality of moving objects 20 of the same model should not be left activated in the standby state. In this example, one moving object 20 is in the standby state in S1, and hence that moving object 20 responds to the search request of S2 (S3).

The operation input device 10 which has received the response of S3 starts a communication connection to the moving object 20 which has responded (S4). From then on, by using the common setting information stored in the permanent storage portion 12*b*, the operation input device 10 can transmit/receive data to/from the moving object 20. Specifically, as described above, the operation signal corresponding to the content of an operation made by the user is transmitted from the operation input device 10, or data of a moving image taken by the camera 25 is transmitted from the moving object 20, with the result that the user can operate the moving object 20 via the operation input device 10.

However, as described above, the common setting information is common to the model, and thus when a plurality of moving objects 20 of the same model exist in the communicable range of the operation input device 10, it is impossible to discriminate those moving objects 20 and perform data transmission/reception to/from a specific moving object 20. Thus, when an instruction has been given from the user, for example, the operation input device 10 performs processing of replacing the common setting information with communication setting information which is set individually (hereinbelow, referred to as specific setting information). Specifically, first, the operation input device 10 determines the specific setting information which is to be set to the moving object 20 currently communicably connected thereto (S5). Here, the operation input device 10 may use a randomly-determined value as the value of the specific setting information, or may receive an instruction input from the user and use a value determined in accordance with the content of the instruction input as the value of the specific setting information. On this occasion, such control may be performed that restricts change of part of the specific setting information. To give a specific example, in a case of rewriting the value of the SSID which contains a character string representing the manufacturer and a character string representing the model of the moving object 20, the specific setting information may be generated by fixing the character string portion representing the manufacturer and replacing only the character string portion representing the model with a random value.

Subsequently, the operation input device 10 transmits, to the moving object 20, an instruction to rewrite the communication setting information with the specific setting information determined in S5 (S6). The moving object 20 which has received the instruction overwrites the common setting information written in the setting information register with the specified specific setting information (S7). Then, after the update to the specific setting information is completed normally, the moving object 20 transmits a response indicating that the update has been completed normally to the operation input device 10 (S8). From then on, the moving object 20 uses the specific setting information stored in S7 and waits for a communication connection from the operation input device 10. Note that, the specific setting information written into the setting information register is held within the moving object 20 until initialization processing to be described later is performed.

Meanwhile, the operation input device 10 which has received the response of S8 stores the specific setting information determined in S6 in the permanent storage portion 12*b*, and then disconnects the communication connection which has been established based on the common setting information between the operation input device 10 and the moving object 20 (S9). Further, the operation input device 10 uses the specific setting information stored in S9, to thereby reestablish the communication connection to the moving object 20 (S10).

According to the processing described above, the communication setting information held by the moving object 20 is rewritten in accordance with an instruction from the operation input device 10, and also, the operation input device 10 reestablishes a communication connection by using the rewritten communication setting information. As a result, a plurality of moving objects 20 which originally have common communication setting information become connected to the corresponding operation input devices 10 by using different pieces of the communication setting information. With this configuration, even when there exist a plurality of moving objects 20 of the same model, the operation input device 10 which has already established a connection can handle the corresponding moving object 20 without crosstalk.

Note that, when a connection has been erroneously established between another operation input device 10 than the user's intended device and the moving object 20, or when it is desired that the moving object 20 be operated by a different operation input device 10 from the operation input device 10 which has been used so far, the processing of rewriting the communication setting information can be executed again as described above by initializing the specific setting information stored in the moving object 20. In order to realize such control, the moving object 20 is provided with a reset switch (not shown). When the user depresses the reset switch, the communication processing module 22 initializes the specific setting information stored in the setting information register with the common setting information (initial information) stored in the ROM. By doing so, the moving object 20 can wait for a communication connection from the operation input device 10 by using the common setting information again. Further, if the operation input device 10 side is also made to, in accordance with an instruction operation of the user, attempt to establish a communication connection by using the common setting information stored in the application program from the next time on, it is possible to establish a communication connection again to the moving object 20 which has initialized the communication setting information.

[Control at the Time of Communication Disconnection]

Next, description is given of processing performed in a case where the communication connection between the operation input device 10 and the moving object 20 has been disconnected while the moving object 20 is being operated for reasons such as a deteriorated communication environment and an extended distance between the operation input device 10 and the moving object 20.

When the communication processing module 22 cannot receive the operation signal from the operation input device 10 for a predetermined period of time, the communication processing module 22 determines that the communication connection to the operation input device 10 has been disconnected, and then outputs a drive signal for causing the moving object 20 to shift to a predetermined state to the drive portion 24. The predetermined state in this case may be, for example, a stopped state in which the moving object 20 has stopped moving or a state in which the motor is no longer driven (that is, state in which the moving object 20 is inertially moving). Further, for example, when the moving object 20 is a submarine which is under water, the predetermined state may be a state in which the moving object 20 is floating on the water surface.

Control information for disconnection is stored in the communication processing module 22. The control information for disconnection is information that defines the content of a drive signal for causing the drive portion 24 to execute a predetermined action, and the predetermined action in this case is an action for causing the moving object 20 to shift to the predetermined state when the communication connection is disconnected. When the communication disconnection is detected, in accordance with the control information for disconnection, the communication processing module 22 generates a drive signal for controlling each of the motors and the like included in the drive portion 24, and then outputs the drive signal to the drive portion 24.

The control information for disconnection may be stored in a register which is rewritable in accordance with an instruction or the like from the user. For example, there is a case where the control to be executed at the time of communication disconnection is desired to be changed depending on the place where the moving object 20 is used or the user's preference. Accordingly, the operation input device 10 generates the control information for disconnection in accordance with the user's instruction input, and then transmits the control information for disconnection, which has been generated in advance, to the moving object 20 under the state in which a communication connection to the moving object 20 is established. The communication processing module 22 which has received the control information for disconnection rewrites default control information for disconnection, which is stored in a predetermined register, with the newly received control information for disconnection. With this, when the communication connection has been disconnected from then on, the communication processing module 22 controls the drive portion 24 in accordance with the rewritten control information for disconnection. With this configuration, at the time of communication disconnection, it is possible to shift the moving object 20 to a state desired by the user. In this case, by depressing the above-mentioned reset switch, the communication processing module 22 may initialize the rewritten control information for disconnection to the default control information for disconnection.

Further, in this embodiment, the communication processing module 22 may add information indicating the strength of the radio signal (electromagnetic wave) transmitted from the operation input device 10 to the response to the operation signal when transmitting the response to the operation input device 10. With this configuration, before the communication connection is disconnected, the operation input device 10 can present warning information to the user in advance by, for example, a method of displaying the warning information on the display portion 14. Further, the operation input device 10 may always display the information indicating the strength of the communication connection on the display portion 14 while the communication connection to the moving object 20 is established.

Note that, the embodiment of the present invention is not limited to the above description. For example, the operation input device 10 and the moving object 20 are not limited to those conforming with the IEEE 802.11 standard and may be any communication device which performs wireless communication in conformity with various kinds of standards. Further, as described above, the moving object 20 is not limited to a vehicle and may be any device provided with various kinds of drive mechanisms. Further, the moving object 20 does not need to include the camera 25. In addition, the moving object 20 of such kind that performs only actions controllable with the standard command does not need to include the unique processing module 23.

Further, in the above description, a device to be operated, which serves as the operation target of the operation input device 10, is the moving object 20 capable of moving. However, the device to be operated according to the embodiment of the present invention is not limited to the moving object, and may be various kinds of devices which perform actions in accordance with the operation signal transmitted from the operation input device. For example, the device to be operated may be a driven unit which stays at a particular position without moving and performs various kinds of actions by using the built-in drive mechanism. Examples of such a driven unit include a camera with a tripod which can be adjusted in height in accordance with the operation signal and a security camera changeable in image taking direction. Further, the device to be operated does not always need to be provided with the drive portion. Even when there is no drive portion, the device to be operated performs an action in accordance with any one of the action signal output by the communication processing module in response to the standard command and the action signal output by the unique processing module in response to the unique command. As a result, the communication processing module can be made compatible with a plurality of kinds of devices to be operated. In other cases, by rewriting the communication setting information held by the device to be operated in response to an instruction to rewrite the communication setting information, which is transmitted from the operation input device, the operation input device can operate only a particular device to be operated from among a plurality of devices to be operated which hold the same communication setting information under the initial state.

The invention claimed is:

1. A remote control system, comprising:

an operation input device; and a device of a certain type to be operated, which performs an action in accordance with an operation signal transmitted from the operation input device by wireless communication, wherein the operation input device transmits to the device to be operated, as the operation signal, both:

a standard operation signal specifying a standard action that is common to said type of device, and a specific operation signal specifying an action unique to the device to be operated;

wherein the device to be operated comprises:

a first processing circuitry operating to receive the operation signal transmitted from the operation input device; and a second processing circuitry operating to control the device to be operated to execute the action unique to the device to be operated, wherein the first processing circuitry causes the device to be operated to execute an action corresponding to a content of the operation signal when the received operation signal is the standard operation signal, and transfers data contained in the operation signal to the second processing circuitry when the received operation signal is the specific operation signal, wherein the second processing circuitry causes the device to be operated to execute an action corresponding to a content of the data transferred from the first processing circuitry, wherein the device to be operated is a moving object which moves in accordance with the operation signal, wherein the device to be operated further comprises a drive portion which is driven in accordance with a drive signal, wherein the drive signal is output from the first processing circuitry or the second processing circuitry, wherein the first processing circuitry outputs, to the drive portion, a drive signal corresponding to the content of the operation signal when the received operation signal is the standard operation signal, and wherein the second processing circuitry outputs, to the drive portion, a drive signal corresponding to the content of the data transferred from the first processing circuitry.

2. The remote control system according to claim 1, wherein the first processing circuitry refers to a predetermined portion contained in the operation signal, to thereby determine whether the operation signal is the standard operation signal or the specific operation signal.

3. The remote control system, comprising of claim 1, wherein:

the first processing circuitry comprises rewritable control information for disconnection, wherein said first processing circuitry outputs, when the wireless communication is disconnected, a drive signal for causing the drive portion to execute a predetermined action in accordance with said control information, so as to shift the moving object to a predetermined state, wherein said first processing circuitry receives alternate control information for disconnection in accordance with instructions inputted by the user and rewrites said control information for disconnection with the alternate control information for disconnection received by the moving object, whereby in the event of disconnection, said moving object shifts to a state desired by the user in accordance with said alternate control information.

4. The remote control system according to claim 3, wherein the operation input device generates control information for disconnection which defines a content of the drive signal for causing the drive portion to execute the predetermined action, and transmits the control information for disconnection to the moving object; and wherein the first processing circuitry holds a content of the transmitted control information for disconnection, and, when the wireless communication is disconnected, outputs the drive signal defined by the held control information for disconnection.

5. The remote control system according to claim 1, wherein the operation input device establishes a communication connection with said moving object by wirelessly accessing common communication setting information stored in a memory of said moving object, wherein said common communication setting information is used to identify the moving object and establish an initial communication connection.

6. The remote control system according to claim 5, wherein said operation input device instructs said moving object to overwrite and update said common communication setting information with specific communication setting information that defines and identifies the specific connection between said operation input device and said moving object after establishing said initial communication connection.

7. The remote control system according to claim 6, wherein after said moving object has been updated with said specific communication setting information, the moving object transmits a response to the operation input device indicating that the update has been completed normally, and said operation input device stores the specific setting information in a permanent storage portion of said operation input device.

8. The remote control system according to claim 7, wherein after said specific setting information is stored in said operation input device the operation input device disconnects the communication connection which was established based on the common setting information and re-establishes a communication connection based on the specific setting information.

9. The remote control system according to claim 1, wherein the moving object outputs a drive signal for causing the moving object to shift to a predetermined state when the first processing circuitry does not receive an operation signal from the operation input device for a predetermined period of time, thus indicating a disconnection.

10. The remote control system according to claim 9, wherein said drive signal causes a driver portion of said moving object to execute a predetermined action that shifts said moving object into the predetermined state, wherein a content of said drive signal is defined in control information for disconnection stored in the communication first processing circuitry.

11. The remote control system according to claim 10, wherein said driver portion comprises one or more motors.

12. The remote control system according to claim 10, wherein said predetermined state is floating on a surface of water.

13. The remote control system according to claim 10, wherein the operation input device is used to generate control information for disconnection, in accordance with user instruction input, wherein said control information is transmitted to the first processing circuitry of the moving object when a communication connection is established, and said control information replaces the control information for disconnection stored in the first processing circuitry.

14. The remote control system according to claim 3, wherein said first processing circuitry is configured to initialize the rewritten control information for disconnection to a default control information for disconnection.

15. The remote control system according to claim 14, wherein said moving object comprises a reset switch, wherein depressing the reset switch causes the first processing circuit to initialize the rewritten control information for disconnection to said default control information for disconnection.

16. The remote control system according to claim 3, wherein said operation input device is configured to generate alternate control information for disconnection in accordance with instructions inputted by the user, and transmit said alternate control information to the moving object when a communication connection with the moving object is established.

17. The remote control system according to claim 3, wherein the alternate control information is an instruction to stop the drive portion.

18. The remote control system according to claim 3, wherein moving object is a toy helicopter.

19. A device of a certain type to be operated, which performs an action in accordance with an operation signal transmitted from an operation input device by wireless communication, the device to be operated comprising:

a first processing circuitry operating to receive, as the operation signal, both a standard operation signal specifying a standard action that is common to said type of device, and a specific operation signal specifying an action unique to the device to be operated, from the operation input device; and a second processing circuitry operating to control the device to be operated to execute the action unique to the device to be operated, wherein the first processing circuitry causes the device to be operated to execute an action corresponding to a content of the operation signal when the received operation signal is the standard operation signal, and transfers data contained in the operation signal to the second processing circuitry when the received operation signal is the specific operation signal, and wherein the second processing circuitry causes the device to be operated to execute an action corresponding to a content of the data transferred from the first processing circuitry wherein the device to be operated is a moving object which moves in accordance with the operation signal, wherein the device to be operated further comprises a drive portion which is driven in accordance with a drive signal, wherein the drive signal is output from the first processing circuitry or the second processing circuitry, wherein the first processing circuitry outputs, to the drive portion, a drive signal corresponding to the content of the operation signal when the received operation signal is the standard operation signal, and wherein the second processing circuitry outputs, to the drive portion, a drive signal corresponding to the content of the data transferred from the first processing circuitry.

20. A first processing circuitry to be installed in a device of a certain type to be operated which performs an action in accordance with an operation signal transmitted from an operation input device by wireless communication, the first processing circuitry comprising:

circuitry operating to receive, as the operation signal, both a standard operation signal specifying a standard action that is common to said type of device, and a specific operation signal specifying an action unique to the device to be operated, from the operation input device;

circuitry operating to generate, when the received operation signal is the standard operation signal, an action signal for causing the device to be operated to execute an action corresponding to a content of the operation signal, and outputting the action signal; and circuitry operating to transfer, when the received operation signal is the specific operation signal, data contained in the operation signal to a further processing circuitry which is included in the device to be operated and performs action control unique to the device to be operated, wherein the device to be operated is a moving object which moves in accordance with the operation signal, wherein the device to be operated further comprises a drive portion which is driven in accordance with a drive signal, wherein the drive signal is output from the first processing circuitry or the further processing circuitry, wherein the circuitry operating to receive outputs, to the drive portion, a drive signal corresponding to the content of the operation signal when the received operation signal is the standard operation signal, and wherein the further processing circuitry outputs, to the drive portion, a drive signal corresponding to the content of the data transferred from the circuitry operating to receive.

21. A method of controlling a device of a certain type to be operated, which comprises a first processing circuitry and a second processing circuitry, and performs an action in accordance with an operation signal transmitted from an operation input device by wireless communication, the method of controlling a device to be operated comprising:

receiving, as the operation signal, both a standard operation signal specifying a standard action that is common to said type of device, and a specific operation signal specifying an action unique to the device to be operated, from the operation input device;

causing, by the first processing circuitry, the device to be operated to execute an action corresponding to a content of the operation signal when the received operation signal is the standard operation signal;

transferring, by the first processing circuitry, data contained in the operation signal to the second processing circuitry when the received operation signal is the specific operation signal; and causing, by the second processing circuitry, the device to be operated to execute an action corresponding to a content of the transferred data, wherein the device to be operated is a moving object which moves in accordance with the operation signal, wherein the device to be operated further comprises a drive portion which is driven in accordance with a drive signal, wherein the drive signal is output from the first processing circuitry or the second processing circuitry, wherein the first processing circuitry outputs, to the drive portion, a drive signal corresponding to the content of the operation signal when the received operation signal is the standard operation signal, and wherein the second processing circuitry outputs, to the drive portion, a drive signal corresponding to the content of the data transferred from the first processing circuitry.

22. A remote control system, comprising:

an operation input device; and a device of a certain type to be operated, which performs an action in accordance with an operation signal transmitted from the operation input device through wireless communication, wherein the operation input device comprises:

circuitry operating to establish a wireless communication connection to the device to be operated, by using communication setting information held in advance in the device to be operated;

circuitry operating to transmit, to the device to be operated, an instruction to rewrite the held communication setting information into other communication setting information by using the established wireless communication connection; and circuitry operating to reestablish the wireless communication connection to the device to be operated, by using the other communication setting information obtained through the rewrite, and wherein the device to be operated comprises:

circuitry operating to hold the communication setting information;

circuitry operating to rewrite the held communication setting information in accordance with the instruction from the operation input device;

circuitry operating to communicate with the operation input device by using the held communication setting information;

a first processing circuitry operating to receive the operation signal transmitted from the operation input device; and a second processing circuitry operating to control the device to be operated to execute the action unique to the device to be operated, wherein when the received operation signal is the standard operation signal the first processing circuitry causes the device to be operated to execute an action that is common to said type of device, and said action corresponds to a content of the operation signal, wherein when the received operation signal is the specific operation signal the first processing circuitry transfers data contained in the operation signal to the second processing circuitry, wherein the second processing circuitry causes the device to be operated to execute an action corresponding to a content of the data transferred from the first processing circuitry, wherein the device to be operated is a moving object which moves in accordance with the operation signal, wherein the device to be operated further comprises a drive portion which is driven in accordance with a drive signal, wherein the drive signal is output from the first processing circuitry or the second processing circuitry, wherein the first processing circuitry outputs, to the drive portion, a drive signal corresponding to the content of the operation signal when the received operation signal is the standard operation signal, and wherein the second processing circuitry outputs, to the drive portion, a drive signal corresponding to the content of the data transferred from the first processing circuitry.

23. The remote control system according to claim 22, wherein the device to be operated further comprises a reset switch, and, when the reset switch is depressed, returns the held communication setting information to initial information.

24. The remote control system according to claim 22, wherein the device to be operated is a moving object which moves in accordance with the operation signal.

* * * * *